US008207657B2

(12) United States Patent
Suzuki et al.

(10) Patent No.: US 8,207,657 B2
(45) Date of Patent: Jun. 26, 2012

(54) SPARK PLUG AND METHOD OF MANUFACTURING THE SAME

(75) Inventors: Akira Suzuki, Nagoya (JP); Mamoru Musasa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/124,869

(22) PCT Filed: Nov. 4, 2009

(86) PCT No.: PCT/JP2009/068843

§ 371 (c)(1),
(2), (4) Date: Apr. 19, 2011

(87) PCT Pub. No.: WO2010/053099

PCT Pub. Date: May 14, 2010

(65) Prior Publication Data

US 2011/0198982 A1 Aug. 18, 2011

(30) Foreign Application Priority Data

Nov. 4, 2008 (JP) ..... 2008-282751

(51) Int. Cl.
*H01T 13/00* (2006.01)
*H01T 13/20* (2006.01)
*H01T 21/00* (2006.01)

(52) U.S. Cl. ..... 313/141; 313/118; 445/7

(58) Field of Classification Search ..... 313/118, 313/139, 141, 140; 445/7
See application file for complete search history.

(56) References Cited

U.S. PATENT DOCUMENTS

| | | | |
|---|---|---|---|
| 2001/0030494 | A1 | 10/2001 | Kanao |
| 2002/0011768 | A1 | 1/2002 | Boehler et al. |
| 2003/0038578 | A1 | 2/2003 | Kanao et al. |
| 2005/0179353 | A1 | 8/2005 | Watanabe |

FOREIGN PATENT DOCUMENTS

| | | | |
|---|---|---|---|
| JP | 51-112131 | U | 9/1976 |
| JP | 2-121289 | A | 5/1990 |
| JP | 2001-284013 | A | 10/2001 |
| JP | 2003-007423 | A | 1/2003 |
| JP | 2003-059617 | A | 2/2003 |
| JP | 2005-228562 | A | 8/2005 |

*Primary Examiner* — Joseph L Williams
(74) *Attorney, Agent, or Firm* — Sughrue Mion, PLLC

(57) ABSTRACT

A spark plug capable of increasing a welding strength between a leading end of a metal shell and a base end of a ground electrode to avoid fracture of a welded part due to vibrations and the like even when making the metal shell smaller. The spark plug satisfies a relation of S2≧S wherein S2 is a sectional area of the welded part between the metal shell and the ground electrode, the sectional area S2 being cut off by a plane including a leading end surface of the metal shell, and S is a sectional area of the ground electrode, the sectional area S being cut off by a plane passing to the most axial leading end of a boundary between the ground electrode and the welded part and perpendicular to the axial direction.

9 Claims, 8 Drawing Sheets

SPARK PLUG AND METHOD OF MANUFACTURING THE SAME

TECHNICAL FIELD

The present invention relates to a spark plug and a method of manufacturing the same, and more particularly, to an improvement of a welded part between a leading end of a metal shell and a base end of a ground electrode.

BACKGROUND ART

A conventional spark plug comprises a cylindrical metal shell that is axially extended and includes a screw part formed at its outer circumference, a cylindrical insulator that is fitted in the metal shell and a cylindrical center electrode that is arranged in the insulator wherein the metal shell, the insulator and the center electrode are arranged so that respective axes thereof are approximately concentric in radial directions thereof. In addition, a cylindrical ground electrode is bent at its center to form a substantial L-shape and includes a base end that is welded to a leading end of the metal shell and a leading end that is opposed to a leading end of the center electrode. Meantime, a predetermined spark discharge gap is formed between the leading end of the center electrode and the leading end of the ground electrode. The spark plug having the above structure is attached to a cylinder head of an internal combustion such as engine and is used as an ignition source for mixture gas to be supplied to a combustion chamber.

As the engine has been recently complicated, it is further required to make the spark plug smaller. For example, it is required to reduce a nominal diameter of the screw part of the metal shell. For doing so, a thickness of the leading end of the metal shell to which the base end of the ground electrode is welded is made to be thinner, so that a thickness of the base end of the ground electrode should be also thinner. As a result, the problems such as wear of the ground electrode, lowering of the durability of the ground electrode due to increase in temperatures and fracture of the ground electrode due to vibrations are caused.

Accordingly, measures of enlarging the thickness of the ground electrode, compared to the prior art, and securing a sufficient sectional area have been suggested (for example, refer to Patent Document 1)

[Prior Documents]

[Patent Documents]

[Patent Document 1] JP-A No. 2003-7423

SUMMARY OF THE INVENTION

Problems to be Solved

As disclosed in Patent Document 1, in order to solve the above problems, a sectional area of the base end of the ground electrode is forcibly enlarged and then the base end is welded to the leading end of the metal shell. Although such measures have led to certain effects regarding the above problems, a welding strength may be insufficient in the stricter using conditions. In other words, a further improvement is needed.

The invention has been made to solve the above problems. An object of the invention is to provide a spark plug in which a welding strength between a leading end of a metal shell and a base end of a ground electrode is increased and fracture of a welded part due to vibrations and the like can be thus prevented more certainly even when a diameter of the metal shell is reduced, and a method of manufacturing the spark plug.

Means for Solving the Problems

The object of the invention is achieved by the following arrangements:

(1) A spark plug comprising:

a cylindrical metal shell extending in an axial direction;

a cylindrical insulator that is held in the metal shell and includes a leading end exposed from a leading end of the metal shell;

a center electrode that is arranged in the insulator so that a leading end of the center electrode is exposed from the leading end of the insulator; and a ground electrode that includes a base end welded to a leading end surface of the metal shell so as to extend from the leading end of the metal shell, a spark discharge gap being formed between a leading end of the ground electrode and the leading end of the center electrode, wherein the base end of the ground electrode is welded to the leading end surface of the metal shell, the base end being protruded radially outward beyond an outer circumferential surface of the leading end of the metal shell and/or radially inward beyond an inner circumferential surface of the leading end of the metal shell, and wherein where S2 represents a sectional area of the welded part between the metal shell and the ground electrode, the sectional area S2 being cut off by a plane including the leading end surface of the metal shell, and S represents a sectional area of the ground electrode, the sectional area S being cut off by a plane which passes to a most leading end of a boundary in the axial direction between the ground electrode and the welded part and is perpendicular to the axial direction, a relation of $S2 \geqq S$ is satisfied.

(2) The spark plug according to (1), wherein a relation of $S2 \geqq 1.1S$ is satisfied.

(3) The spark plug according to (1) or (2), wherein the welded part includes a portion of the leading end of the metal shell, which is radially protruded when welding the metal shell and the ground electrode.

(4) The spark plug according to one of (1) to (3), wherein a relation between a radial thickness t of the leading end of the metal shell and a thickness T of the base end of the ground electrode is $t<T$.

(5) The spark plug according to one of (1) to (4), wherein an average thickness W of a welding-protruded portion of the welded part in the axial direction is 0.1 mm or greater ($W \geqq 0.1$ mm), in which the welding-protruded portion is protruded outward beyond the ground electrode and includes 50 mass % or more of constitutional components of the ground electrode.

(6) The spark plug according to one of (1) to (5), wherein the welding-protruded portion is formed at least one of long sides of a cross sectional plane of the ground electrode.

(7) The spark plug according to one of (1) to (6), wherein the metal shell includes a screw part formed at an outer circumference of the metal shell for attaching the spark plug to a counterpart member and a nominal diameter of the screw part is M 10 or less.

(8) A method of manufacturing a spark plug comprising a cylindrical metal shell extending in an axial direction; a cylindrical insulator that is held in the metal shell and includes a leading end exposed from a leading end of the metal shell; a center electrode that is arranged in the insulator so that a leading end of the center electrode is exposed from the leading end of the insulator; and a ground electrode that includes a base end resistance-welded to a leading end surface of the metal shell so as to extend from the leading end of the metal shell, wherein a spark discharge gap is formed between a leading end of the ground electrode and the leading end of the center electrode, wherein a relation between a radial thickness t of the leading end of the metal shell and a thickness T of the base end of the ground electrode is t>T, wherein when resistance-welding the base end of the ground electrode to the leading end surface of the metal shell, the resistance-welding is performed with a cylindrical welding chuck that is fitted on the ground electrode and is provided with a relief part used for accommodating melted metal at an edge of an inner circumferential surface of the welding chuck, the edge being located at the base end of the ground electrode in performing the resistance-welding, and wherein when a sectional area of the welded part between the metal shell and the ground electrode is indicated with S2, the sectional area S2 being cut off by a plane including the leading end surface of the metal shell, and a sectional area of the ground electrode is indicated with S, the sectional area S being cut off by a plane passing to the most leading end of a boundary in the axial direction between the ground electrode and the welded part and perpendicular to the axial direction, a relation of S2≧S is satisfied.

(9) The method according to (8), wherein the metal shell includes a screw part formed at an outer circumference of the metal shell for attaching the spark plug to a counterpart member and a nominal diameter of the screw part is M 10 or less.

According to the structure of (1), even when the base end of the ground electrode is welded with being protruded from the leading end of the metal shell so as to increase a thickness of the ground electrode, the relation of S2≧S is satisfied where S2 is a sectional area of the welded part between the metal shell and the ground electrode, the sectional area S2 being cut off by a plane including the leading end surface of the metal shell, and S is a sectional area of the ground electrode, the sectional area S being cut off by a plane passing to the most axial leading end of a boundary between the ground electrode and the welded part and perpendicular to the axial direction. Accordingly, it is possible to make a sectional area of the welded part between the leading end of the metal shell and the base end of the ground electrode greater than that of the base end of the ground electrode. Thereby, it is possible to increase the welding strength between the leading end of the metal shell and the base end of the ground electrode and to thus prevent the fracture of the welded part due to vibrations and the like more certainly even when a diameter of the metal shell is reduced.

According to the structure of (2), since S2≧1.1S is satisfied, it is possible to make a sectional area of the welded part between the leading end of the metal shell and the base end of the ground electrode greater than that of the base end of the ground electrode. Thus, it is possible to further increase the welding strength between the leading end of the metal shell and the base end of the ground electrode.

According to the structure of (3), the welded part may preferably include a portion of the leading end of the metal shell that is radially protruded when welding the metal shell and the ground electrode. In this case, it is possible to efficiently increase the welding strength between the leading end of the metal shell and the base end of the ground electrode.

According to the structure of (4), even when a relation of t<T is made where t is a radial thickness of the leading end of the metal shell and T is a thickness of the base end of the ground electrode, it is possible to efficiently increase the welding strength between the leading end of the metal shell and the base end of the ground electrode by the invention.

According to the structure of (5), an average thickness W of a welding-protruded portion of the welded part in the axial direction is 0.1 mm or greater (W≧0.1 mm), in which the welding-protruded portion is protruded outward beyond the ground electrode and includes 50 mass % or more of constitutional components of the ground electrode. Thus, since there is no concern that a crack is generated in the welded part, it is possible to further increase the welding strength.

According to the structure of (6), the welding-protruded portion exists at a long side of a cross sectional plane of the ground electrode to which more stress is applied. Thus, it is possible to further increase the welding strength.

According to the structure of (7), even when a nominal diameter of the screw part of the metal shell is markedly small, such as M10 or less, it is possible to efficiently increase the welding strength between the leading end of the metal shell and the base end of the ground electrode by the invention.

According to the structure of (8), in order to satisfy the relation of S2≧S when resistance-welding the base end of the ground electrode to the leading end surface of the metal shell, a relief part of melted metal is provided to an edge of an inner circumferential surface of a cylindrical welding chuck fitted on the ground electrode, the edge being located at the base end of the ground electrode in performing the resistance-welding. Thereby, it is possible to positively make the welded part between the metal shell and the ground electrode greater. Accordingly, even when a relation of t<T is made where t is a radial thickness of the leading end of the metal shell and T is a thickness of the base end of the ground electrode, it is possible to efficiently increase the welding strength between the leading end of the metal shell and the base end of the ground electrode by the invention.

According to the structure of (9), even when a nominal diameter of the screw part of the metal shell is markedly small, such as M10 or less, it is possible to efficiently increase the welding strength between the leading end of the metal shell and the base end of the ground electrode by the invention.

Effects of the Invention

According to the invention, it is possible to provide a spark plug and a method of manufacturing the spark plug wherein the welding strength between the leading end of the metal shell and the base end of the ground electrode is increased and thus the fracture of the welded part due to vibrations and the like can be prevented more certainly even when a diameter of the metal shell is reduced.

BRIEF DESCRIPTIONS OF THE DRAWINGS

Figure 6A:
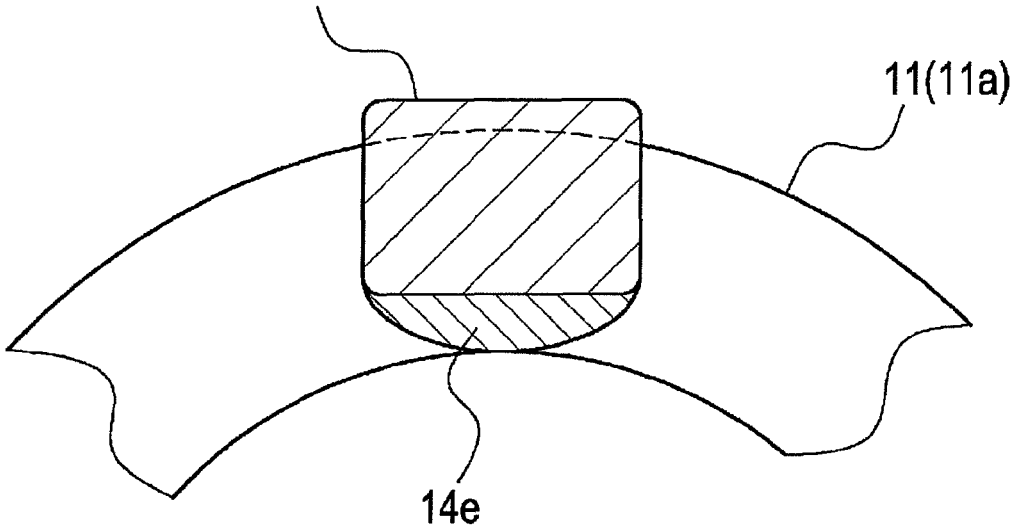
Figure 6B:
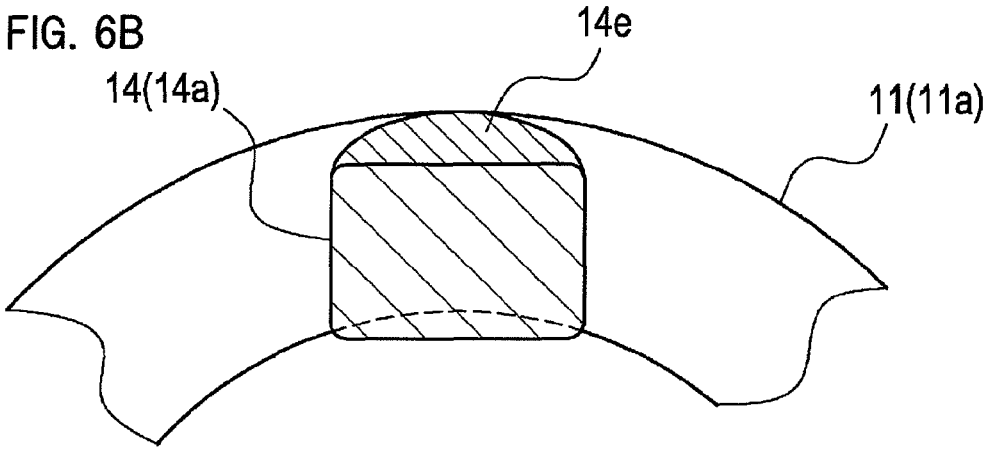
Figure 6C:
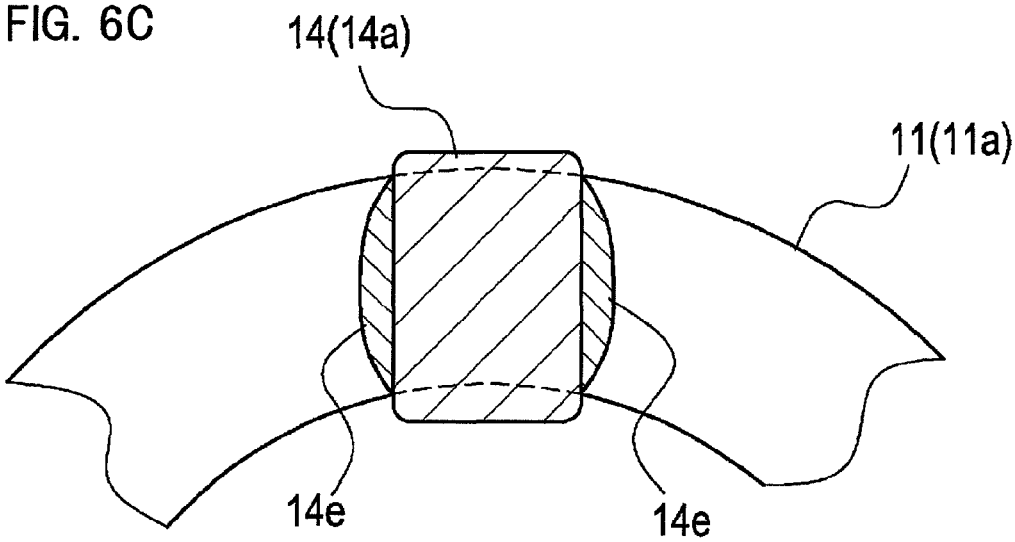

FIG. 6(*a*) is a sectional view of a welded part in which a welding-protruded portion of the welded part is located at an inner long side of a cross sectional plane of the ground electrode, FIG. 6(*b*) is a sectional view of a welded part in which a welding-protruded portion of the welded part is located at an outer long side of the cross sectional plane of the ground electrode and FIG. 6(*c*) is a sectional view of a welded part in which a welding-protruded portion of the welded part is located at two long sides of the cross sectional plane of the ground electrode when welding is performed so that two short sides of the ground electrode are located at inner and outer sides.

Figure 7:
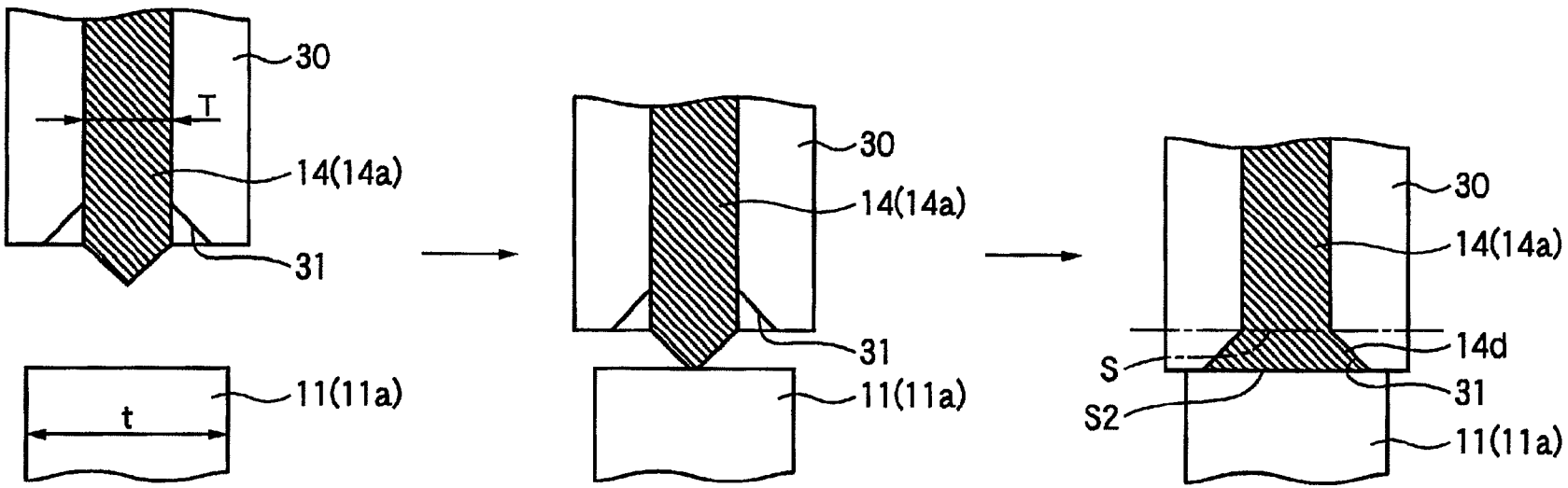

FIG. 7 is a process view for illustrating an exemplary embodiment of a method of manufacturing a spark plug according to the invention.

Figure 8:
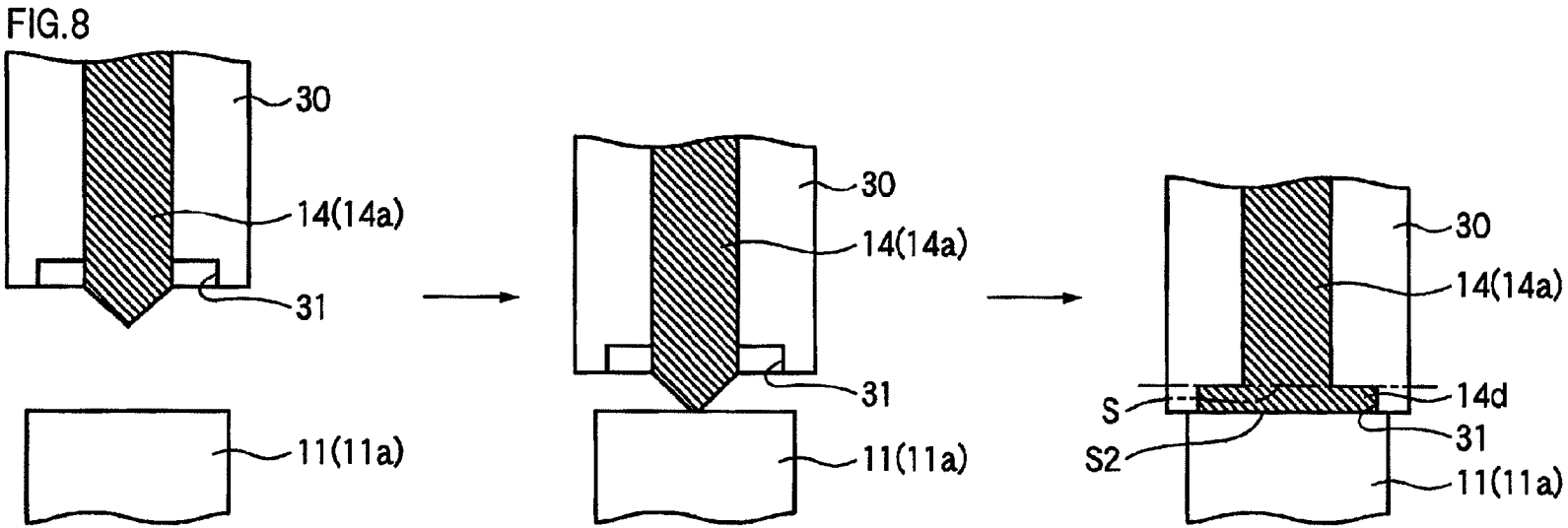

FIG. 8 is a process view for illustrating a first modified embodiment of a method of manufacturing a spark plug according to the invention.

Figure 9:
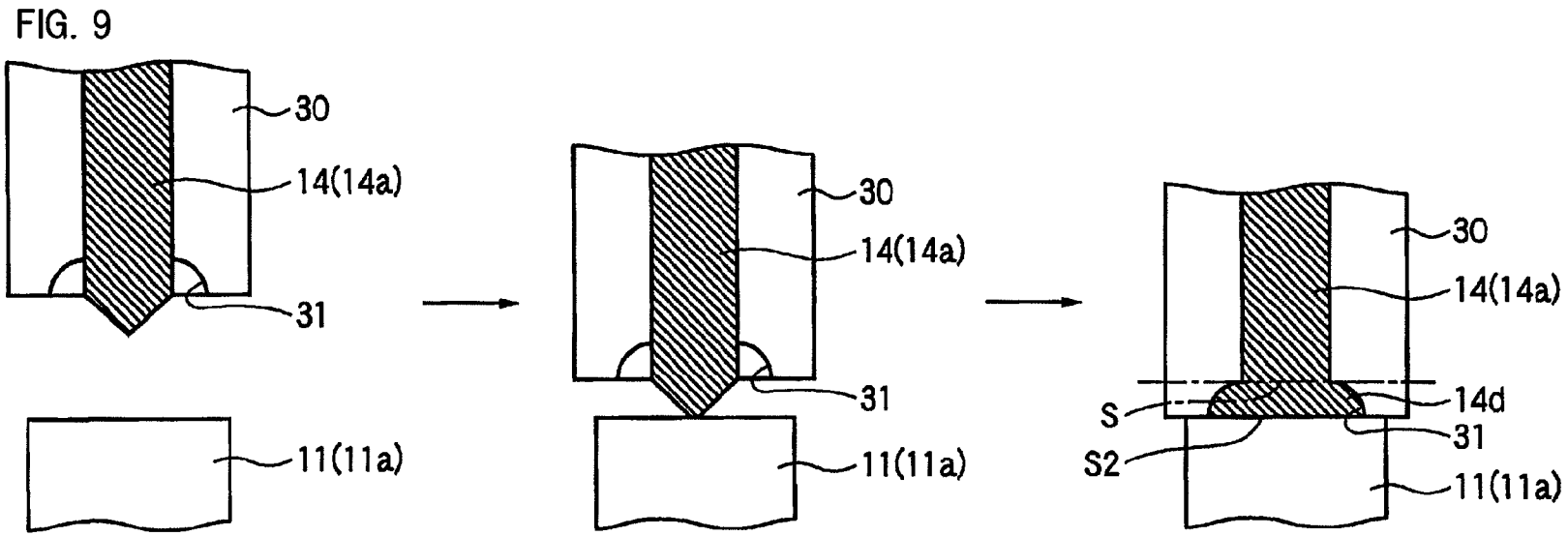

FIG. 9 is a process view for illustrating a second modified embodiment of a method of manufacturing a spark plug according to the invention.

DESCRIPTIONS OF EXEMPLARY EMBODIMENTS

Hereinafter, a spark plug and a method of manufacturing the spark plug according to preferred exemplary embodiments of the invention will be described with reference to the drawings.

Figure 1:
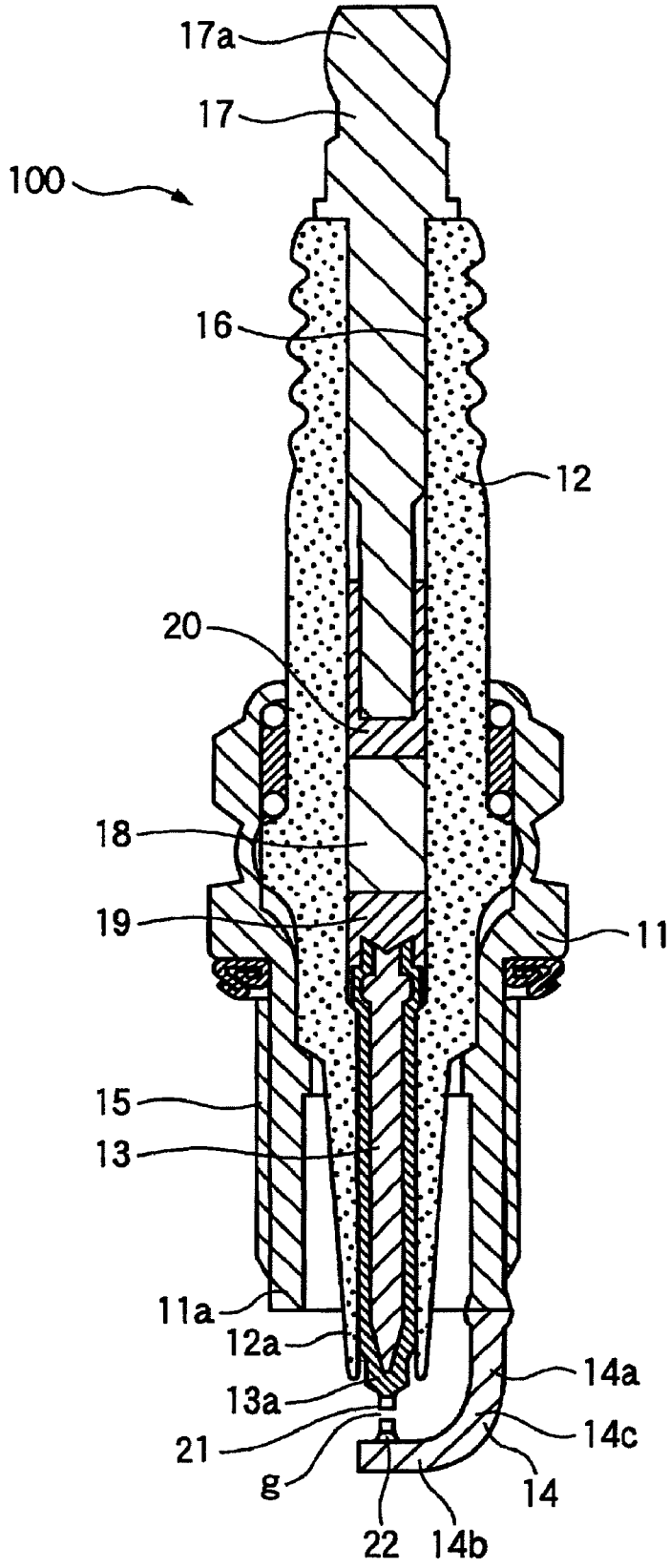
FIG. 1 is a sectional view of a spark plug according to an exemplary embodiment of the invention.
Figure 2:
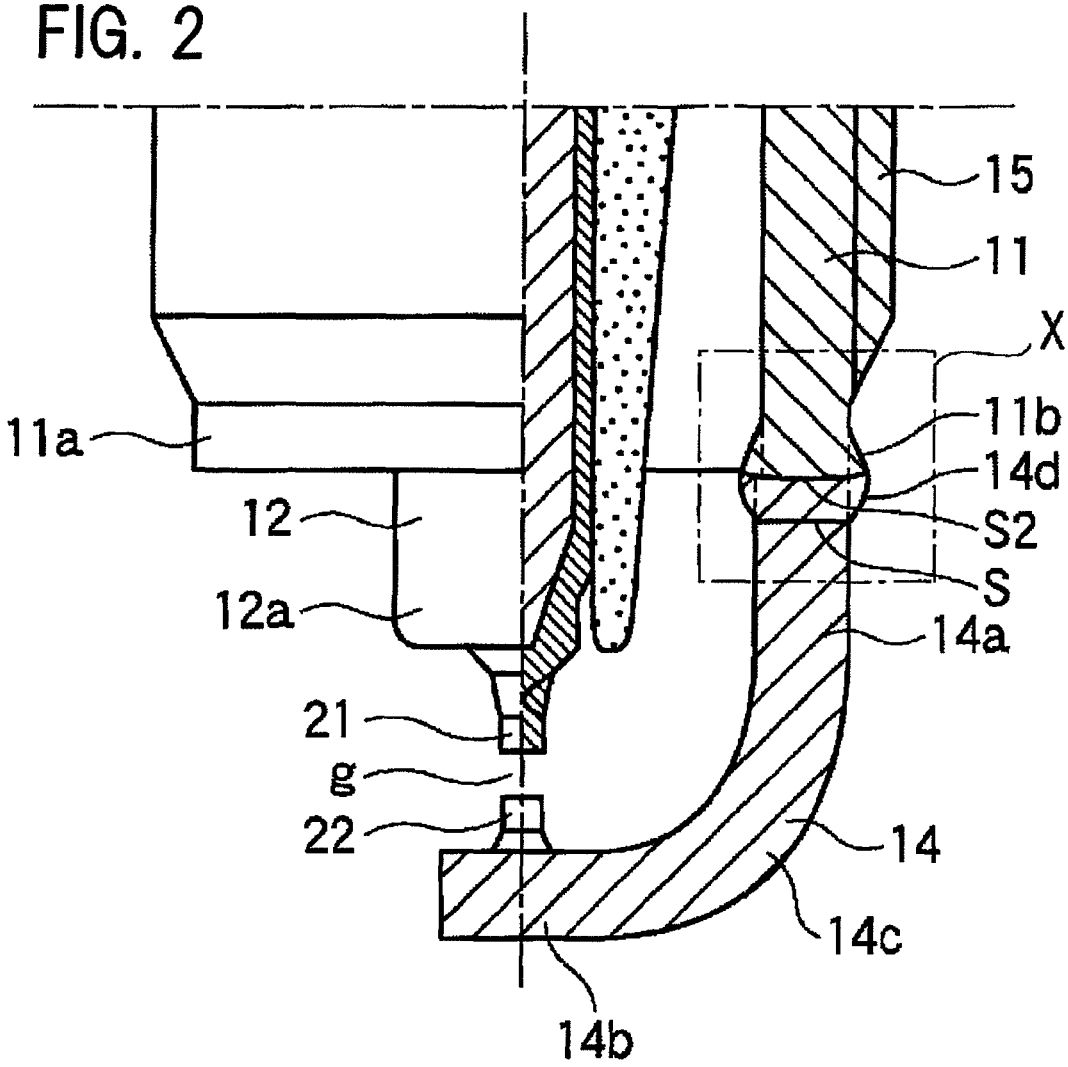
FIG. 2 is an enlarged view of main parts of the park plug shown in FIG. 1.
Figure 3:
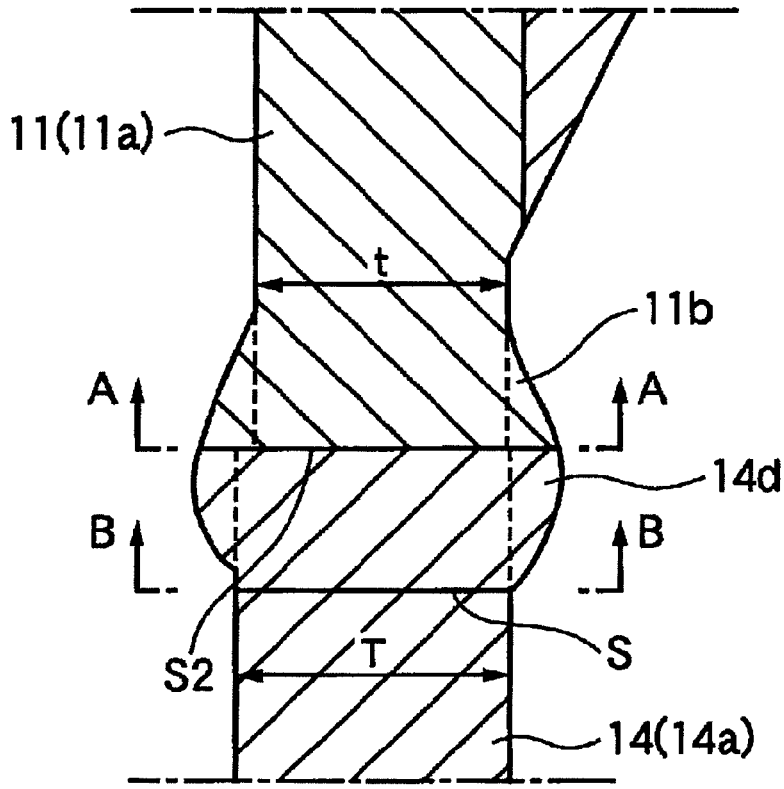
FIG. 3 is an enlarged sectional view of an X part shown in FIG. 2.
Figure 4A:
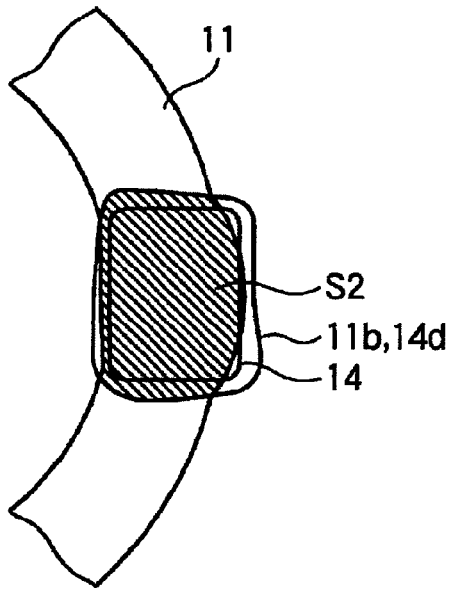
FIG. 4(*a*) is a sectional view taken along a line A-A in FIG. 3 and FIG. 4(*b*) is a sectional view taken along a line B-B in FIG. 3.
Figure 4B:
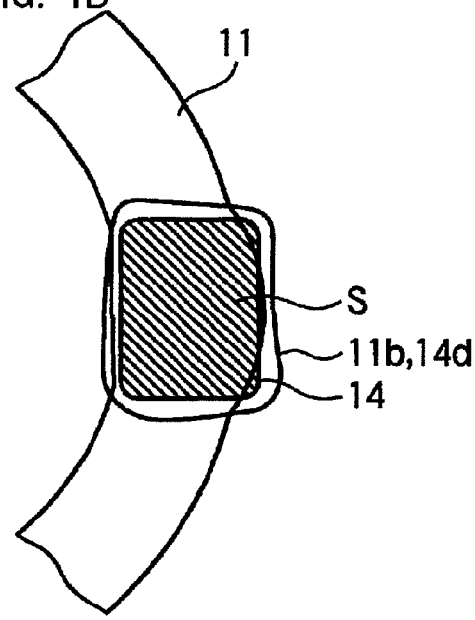

FIG. 1 is a sectional view of a spark plug according to an exemplary embodiment of the invention, FIG. 2 is an enlarged view of main parts of the park plug shown in FIG. 1, FIG. 3 is an enlarged sectional view of an X part shown in FIG. 2, FIG. 4(*a*) is a sectional view taken along a line A-A in FIG. 3 and FIG. 4(*b*) is a sectional view taken along a line B-B in FIG. 3.

As shown in FIG. 1, a spark plug 100 of this exemplary embodiment comprises a cylindrical metal shell 11 that is axially extended, a cylindrical insulator 12 that is fitted in the metal shell 11 and includes a leading end 12*a* exposed from a leading end 11*a* of the metal shell 11, a center electrode 13 disposed in the insulator 12 so that a leading end 13*a* thereof is exposed from the leading end 12*a* of the insulator 12 and a ground electrode 14 that includes a base end 14*a* welded to the leading end 11*a* of the metal shell 11 so as to extend from the leading end 11*a* and a leading end 14*b* axially opposed to the leading end 13*a* of the center electrode 13.

In the below descriptions, an axial side of the metal shell 11 to which the center electrode 13 is disposed is referred to as a front side and an opposite side (a side to which a terminal metal fitting 17 is disposed) is referred to a rear side.

The metal shell 11 is made of carbon steel and the like and is formed at its outer circumferential surface with a screw part 15 for attaching the spark plug to a cylinder head (a counterpart member) of an internal combustion engine, for example. A terminal metal fitting 17 is inserted and fixed, with a leading end 17*a* thereof being exposed, into the insulator 12 made of fired ceramics such as alumina at a rearward end (the above in FIG. 1) of a through hole 16 that is axially formed, and the center electrode 13 is inserted and fixed therein at a forward end (the below in FIG. 1) with the leading end 13*a* thereof being exposed.

Meanwhile, in this exemplary embodiment, a nominal diameter of the screw part 15 is M10 or less.

Additionally, in the through hole 16, a resistance member 18 is arranged at a central portion between the terminal metal fitting 17 and the center electrode 13 and conductive glass seal layers 19, 20 are disposed at both axial ends of the resistance member 18. In other words, the center electrode 13 and the terminal metal fitting 17 are electrically connected to each other via the resistance member 18 and the conductive glass seal layers 19, 20. The conductive glass seal layers 19, 20 and the resistance member 18 form a conductive connection layer.

The center electrode 13 is formed into a cylinder shape by Ni alloy having excellent heat and corrosion resistances, such as Inconel™. The leading end 13*a* of the center electrode 13 is fixedly connected with a cylindrical noble metal chip 21 by laser welding and the like, which is made of alloy (Ir-5Pt) having iridium as a main component and containing 5 mass % of platinum.

The ground electrode 14 is a prismatic member made of Ni alloy having excellent heat and corrosion resistances, comprises a base end 14*a* welded to the leading end 11*a* of the metal shell 11, a leading end 14*b* axially opposed to the center electrode 13 and a bent portion 14*c* at a center thereof and is bent into an approximately L-shape. A cylindrical noble metal chip 22 of the ground electrode 14, which is made of alloy (Pt-20Rh) having platinum as a main component and containing 20 mass % of rhodium, for example, is fixedly connected to a position that is axially opposite to the noble metal chip 21 of the center electrode 13, by laser welding and the like.

Thereby, a spark discharge gap (g) is formed between the noble metal chip 21 of the center electrode 13 and the noble metal chip 22 of the ground electrode 14. A distance of the spark discharge gap (g) is set to be approximately 0.9 mm, for example. Under such state, when a high voltage is applied between the noble metal chip 22 of the ground electrode 14 and the noble metal chip 21 of the center electrode 13, a spark discharge is caused in the spark discharge gap (g). As a result, the spark plug 100 of this exemplary embodiment serves as an ignition source of an engine.

As the noble metals used for the chips 21, 22 of the spark plug 100, materials having high oxidation resistance and spark-proof consumption are used, such as alloy having iridium (Ir) as a main component and containing at least one additive of Pt, Rh, Ni, W, Pd, Ru, Re, $Al_2O_3$, Y, $Y_2O_3$ and the like or alloy having platinum (Pt) as a main component and containing at least one additive of Ir, Rh, Ni, W, Pd, Ru, Re and the like.

Typically, the spark plug 100 is used by applying a minus high voltage to the center electrode 13 to cause a spark discharge. Accordingly, in many cases, the spark consumption of the chip 21 of the center electrode 13 is high. Due to this, a noble metal chip made of iridium-based alloy having high spark-proof consumption is used for the chip 21 of the center electrode 13.

In the meantime, since the ground electrode 14 is attached so that it is most protruded in the combustion chamber, the ground electrode is apt to be at high temperatures. Thus, the oxidation resistance (specifically, oxidation volatility resistance) is required for the chip 22 of the ground electrode 14. Due to this, a noble metal chip made of platinum-based alloy having high oxidation resistance is mainly used for the chip 22 of the ground electrode 14.

In this exemplary embodiment, as shown in FIGS. 2 and 3, a radial thickness t of the leading end 11*a* of the metal shell 11 (when the leading end 11*a* is chamfered, a thickness of a part except the chamfered part) is smaller than a thickness T of the base end 14*a* of the ground electrode 14 (i.e., a relation of $t<T$ is made). In addition, a welded part (a part that is influenced by welding heat and metal structures thereof are changed) between the leading end 11*a* of the metal shell 11 and the base end 14*a* of the ground electrode 14 comprises a radially protruded portion 11*b* of the leading end 11*a* of the metal shell 11 (a welded portion of the metal shell side) and a protruded portion 14*d* of the base end 14*a* of the ground electrode 14 (a welded portion of the ground electrode side), which protruded portions are formed in welding the metal shell 11 and the ground electrode 14.

Meanwhile, in FIGS. 2 and 3, both the metal shell 11 and the ground electrode 14 have the welded portions 11*b*, 14*d* formed thereto. However, when a relation of t<T is made, it is preferable that the welded portion 11*b* is formed at the metal shell 11 with respect to the increase in welding strength.

As shown in FIGS. 3 and 4(*a*), when a sectional area (an area of a A-A section in FIG. 3) of the welded portion between the leading end 11*a* of the metal shell 11 and the base end 14*a* of the ground electrode 14 is indicated with S2, the sectional area S2 being cut off by a plane including the leading end surface of the metal shell 11, and a sectional area (an area of a B-B section in FIG. 3) of the ground electrode 14 is indicated with S2, the sectional area S being cut off by a plane passing to the most axial leading end of a boundary between the ground electrode 14 and the welded portion (welded portion 14*d* of the ground electrode side) and perpendicular to the axial direction, a relation of S2≧S (preferably, S2≧1.1S) is satisfied.

In addition, when seen from the axial direction, the base end 14*a* of the ground electrode 14 is disposed at a more inner side than an outer circumferential line of the welded part.

Additionally, when the radial thickness t of the leading end 11*a* of the metal shell 11 is smaller than the thickness T of the base end 14*a* of the ground electrode 14 (i.e., t<T), the lateral spark leap is suppressed. Considering this, it is preferable to weld the metal shell 11 and the ground electrode 14 so that an amount of outward protrusion that the base end 14*a* of the ground electrode 14 is protruded radially outward beyond the outer circumferential surface of the leading end 11*a* of the metal shell 11 is greater than an amount of inner protrusion that the base end 14*a* of the ground electrode 14 is protruded radially inward beyond the inner circumferential surface of the leading end of the metal shell. In addition, it is preferable to weld the metal shell and the ground electrode so that the base end 14*a* of the ground electrode 14 is not protruded radially inward beyond the inner circumferential surface of the leading end 11*a* of the metal shell 11 and is just protruded radially outward beyond the outer circumferential surface of the leading end of the metal shell.

Figure 5:
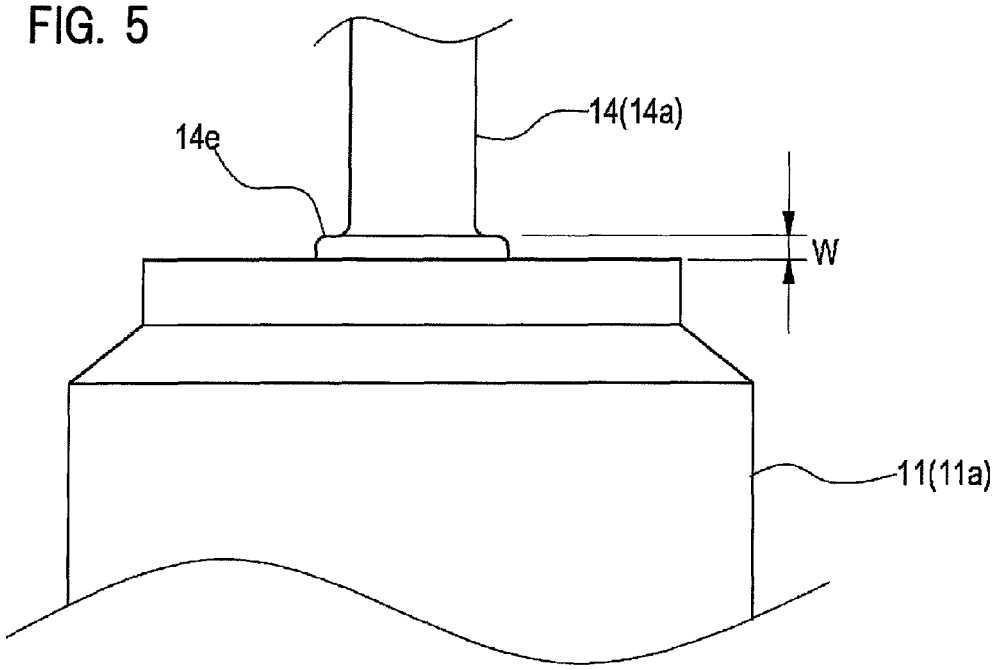
FIG. 5 is a side view showing an axial average thickness W of a welding-protruded portion of a welded part, which is protruded outward beyond a ground electrode and includes 50 mass % or more of constitutional components of the ground electrode.

Here, as shown in FIG. 5, it is preferable that an axial average thickness W of a welding-protruded portion 14*e* of the welded part, which is protruded outward beyond the ground electrode 14 and includes 50 mass % or more of the constitutional components of the ground electrode 14, is 0.1 mm or greater (i.e., W≧0.1 mm).

Herein, the average thickness W is an average of axial thickness of the welding-protruded portion 14*e*, which includes 50 mass % or more of the constitutional components of the ground electrode 14, the axial thickness being measured at different positions (for example, ten (10) different positions) of the ground electrode 14.

In addition, as shown in FIGS. 6(*a*), 6(*b*) and 6(*c*), it is preferable that the welding-protruded portion 14*e* is formed at one or more long sides of a cross sectional plane of the ground electrode 14. FIG. 6(*a*) shows an example in which the welding-protruded portion 14*e* of the welded part is located at an inner long side of a cross sectional plane of the ground electrode 14. FIG. 6(*b*) shows an example in which the welding-protruded portion 14*e* of the welded part is located at an outer long side of the cross sectional plane of the ground electrode 14. FIG. 6(*c*) shows an example in which the welding-protruded portions 14*e* of the welded part are located at two long sides of the cross sectional plane of the ground electrode 14 when welding is performed so that two short sides of the ground electrode are located at inner and outer sides.

As described above, according to the spark plug 100 of this exemplary embodiment, the relation of S2≧S is satisfied where S2 is a sectional area of the welded part between the metal shell 11 and the ground electrode 14, the sectional area S2 being cut off by a plane including the leading end surface of the metal shell 11, and S is a sectional area of the ground electrode 14, the sectional area S being cut off by a plane passing to the most axial leading end of a boundary between the ground electrode 14 and the welded portion and perpendicular to the axial direction. Accordingly, it is possible to make a sectional area of the welded part between the leading end 11*a* of the metal shell 11 and the base end 14*a* of the ground electrode 14 greater than that of the base end 14*a* of the ground electrode 14. Thereby, it is possible to increase the welding strength between the leading end 11*a* of the metal shell 11 and the base end 14*a* of the ground electrode 14 and to thus prevent the fracture of the welded part due to vibrations and the like more certainly even when the nominal diameter of the screw part 15 of the metal shell 11 is reduced, specifically M10 or less.

In addition, since the relation of S2≧1.1S is satisfied, it is possible to make a sectional area of the welded part between the leading end 11*a* of the metal shell 11 and the base end 14*a* of the ground electrode 14 greater than that of the base end 14*a* of the ground electrode 14. Thus, it is possible to further increase the welding strength between the leading end 11*a* of the metal shell 11 and the base end 14*a* of the ground electrode 14.

In addition, the welded part preferably includes a portion of the leading end 11*a* of the metal shell 11 that is radially protruded when welding the metal shell 11 and the ground electrode 14. In this case, it is possible to efficiently increase the welding strength between the leading end 11*a* of the metal shell 11 and the base end 14*a* of the ground electrode 14.

Additionally, even when the relation of t<T is made where t is a radial thickness of the leading end 11*a* of the metal shell 11 and T is a thickness of the base end 14*a* of the ground electrode 14, it is possible to efficiently increase the welding strength between the leading end 11*a* of the metal shell 11 and the base end 14*a* of the ground electrode 14 according to this exemplary embodiment.

Furthermore, when an axial average thickness W of a welding-protruded portion 14*e* of the welded part, which is protruded outward beyond the ground electrode 14 and includes 50 mass % or more of the constitutional components of the ground electrode 14, is 0.1 mm or greater (i.e., W≧0.1 mm), there is no concern that a crack is generated in the welded part. Thus, it is possible to further increase the welding strength.

Additionally, the welding-protruded portion 14*e* is formed at one or more long sides of the cross sectional plane of the ground electrode 14, so that it is possible to further increase the welding strength more efficiently.

In addition, even when a nominal diameter of the screw part 15 of the metal shell 11 is markedly small, such as M10 or less, it is possible to efficiently increase the welding strength between the leading end 11*a* of the metal shell 11 and the base end 14*a* of the ground electrode 14.

In the followings, an exemplary embodiment of a method of manufacturing the spark plug 100 will be described with reference to FIGS. 7 to 9.

FIG. 7 is a process view for illustrating an exemplary embodiment of a method of manufacturing a spark plug according to the invention. FIG. 8 is a process view for illustrating a first modified embodiment of a method of manufacturing a spark plug according to the invention. FIG. 9 is a process view for illustrating a second modified embodiment of a method of manufacturing a spark plug according to the invention. Meanwhile, since the basic structures of the spark plug are the same as FIG. 1, the same reference numerals are used.

In this exemplary embodiment, the radial thickness t of the leading end 11*a* of the metal shell 11 is greater that the thickness T of the base end 14*a* of the ground electrode 14 (i.e., t>T). In addition, when bonding the base end 14*a* of the ground electrode 14 to the leading end 11*a* of the metal shell 11 by resistance welding, the welding is performed by using a cylindrical welding chuck 30 that is fitted on the ground electrode 14.

A relief part 31 of melted metal for releasing metal melted in performing the resistance welding to a predetermined position is provided to an edge of an inner circumferential surface of the welding chuck 30, which edge is located at the base end 14*a* of the ground electrode 14 in performing the resistance welding. The relief part 31 corresponds to formation of the welded portion 14*d* of the ground electrode side having a shape that is protruded into the radially outward and inward directions of the metal shell 11 by the heat influence of the welding, after the resistance welding is completed. In this exemplary embodiment, the relief part has a taper shape whose diameter is gradually increased toward the metal shell 11. However, the invention is not limited thereto. For example, the relief part 31 may adopt a variety of sectional shapes, such as a rectangular shape as shown in FIG. 8 or a circular arc shape as shown in FIG. 9.

When the resistance welding is performed with the welding chuck 30 formed as described above, the relation of S2≧S is satisfied where S2 is a sectional area of the welded part between the metal shell 11 and the ground electrode 14 after completion of the resistance welding, the sectional area S2 being cut off by a plane including the leading end surface of the metal shell 11, and S is a sectional area of the ground electrode 14, the sectional area S being cut off by a plane passing to the most axial leading end of a boundary between the ground electrode 14 and the welded portion and perpendicular to the axial direction.

As described above, according to the method of manufacturing the spark plug 100 of this exemplary embodiment, in order to satisfy the relation of S2≧S when resistance-welding the base end 14*a* of the ground electrode 14 to the leading end surface of the metal shell 11, the relief part 31 of melted metal is provided to the edge of the inner circumferential surface of the cylindrical welding chuck 30 fitted on the ground electrode 14, the edge being located at the base end of the ground electrode 14 in performing the resistance-welding. Thereby, it is possible to positively make the welded part between the metal shell 11 and the ground electrode 14 greater. Accordingly, even when a nominal diameter of the screw part 15 of the metal shell 11 is markedly small and a relation of t>T is made where t is a radial thickness of the leading end 11*a* of the metal shell 11 and T is a thickness of the base end 14*a* of the ground electrode 14, it is possible to efficiently increase the welding strength between the leading end 11*a* of the metal shell 11 and the base end 14*a* of the ground electrode 14.

In addition, even when a nominal diameter of the screw part 15 of the metal shell 11 is markedly small, such as M10 or less, it is possible to efficiently increase the welding strength between the leading end 11*a* of the metal shell 11 and the base end 14*a* of the ground electrode 14.

[Embodiments]

In the followings, the relation between the sectional area S2 and the sectional area S for increasing the welding strength between the leading end 11*a* of the metal shell 11 and the base end 14*a* of the ground electrode 14 will be more specifically described with reference to Tables indicating evaluation test results.

In the meantime, the evaluation tests were performed with spark plugs having the same basic structures as the spark plug 100 of the above embodiment.

First, the sectional area S and the longitudinal length L of the ground electrode 14 were made to be 3.49 mm2 and 9.6 mm and the sectional area S2 of the welded part between the leading end 11*a* of the metal shell 11 and the base end 14*a* of the ground electrode 14 was changed to prepare the spark plugs of comparative examples 1~3 that did not satisfy the relation of S2≧S and the spark plugs of embodiments 1~9 of the invention that satisfied the relation of S2≧S.

In the meantime, the spark plugs of embodiments 4~9 satisfied the relation of S2≧1.1S.

The igniter of the spark plug attached to a JIS impact tester was heated with a blast burner so that the temperature of the leading end 14*a* of the ground electrode 14 was 800° C. under state in which the impact test was suspended. Under impact conditions of JISB8031 (2006), the spark plugs of comparative examples 1~3 and embodiments 1~9 were subject to the impact test ten times (N=10) for 120 minutes. The evaluation was made as follows: for a case where a fractured portion of the ground electrode 14 was the welded portion of the ground electrode 14, a result thereof was considered rejection, and for the other cases, a result thereof was considered pass. The evaluation result is shown in Table 1.

TABLE 1

| | S2 | S2/S | evaluation result the number of passes of evaluations (N = 10) |
|---|---|---|---|
| comparative example 1 | 2.48 | 0.71 | 0 |
| comparative example 2 | 2.91 | 0.84 | 2 |
| comparative example 3 | 3.25 | 0.93 | 5 |
| embodiment 1 | 3.49 | 1.00 | 10 |
| embodiment 2 | 3.69 | 1.06 | 10 |
| embodiment 3 | 3.78 | 1.08 | 10 |
| embodiment 4 | 3.83 | 1.10 | 10 |
| embodiment 5 | 4.00 | 1.15 | 10 |
| embodiment 6 | 4.16 | 1.19 | 10 |
| embodiment 7 | 4.40 | 1.26 | 10 |
| embodiment 8 | 4.63 | 1.33 | 10 |
| embodiment 9 | 4.94 | 1.42 | 10 |

As can be seen from Table 1, for the spark plugs of comparative examples 1~3 that did not satisfy the relation of S2≧S, the number of passes was 5 or less. However, for all the spark plugs of embodiments 1~9 that satisfied the relation of S2≧S, the number of passes was 10. In other words, it could be confirmed that the welding strength between the leading end 11*a* of the metal shell 11 and the base end 14*a* of the ground electrode 14 was high.

Next, the igniter of the spark plug attached to the JIS impact tester was heated with the blast burner so that the temperature of the leading end 14*a* of the ground electrode 14 was 800° C. under state in which the impact test was suspended. Under impact conditions of JISB8031 (2006), the spark plugs of comparative examples 1~3 and embodiments 1~9 were subject to the impact test ten times (N=10) for 180 minutes. The evaluation was made as follows: for a case where a fractured portion of the ground electrode 14 was the welded portion of the ground electrode 14, a result thereof was considered rejection, and for the other cases, a result thereof was considered pass. The evaluation result is shown in Table 2.

TABLE 2

| | S2 | S2/S | evaluation result the number of passes of evaluations (N = 10) |
|---|---|---|---|
| comparative example 1 | 2.48 | 0.71 | 0 |
| comparative example 2 | 2.91 | 0.84 | 0 |
| comparative example 3 | 3.25 | 0.93 | 0 |
| embodiment 1 | 3.49 | 1.00 | 2 |
| embodiment 2 | 3.69 | 1.06 | 4 |
| embodiment 3 | 3.78 | 1.08 | 7 |
| embodiment 4 | 3.83 | 1.10 | 10 |
| embodiment 5 | 4.00 | 1.15 | 10 |
| embodiment 6 | 4.16 | 1.19 | 10 |
| embodiment 7 | 4.40 | 1.26 | 10 |
| embodiment 8 | 4.63 | 1.33 | 10 |
| embodiment 9 | 4.94 | 1.42 | 10 |

As can be seen from Table 2, for all the spark plugs of comparative examples 1~3 that did not satisfy the relation of S2≧S, the number of passes was zero (0). However, for the spark plugs of embodiments 1~3 that satisfied the relation of S2≧S, the number of passes was 2~7. In particular, for all the spark plugs of embodiments 4~9 that satisfied the relation of S2≧1.1S, the number of passes was 10. In other words, it could be confirmed that the welding strength between the leading end 11*a* of the metal shell 11 and the base end 14*a* of the ground electrode 14 was high.

Next, the igniter of the spark plug attached to the JIS impact tester was heated with the blast burner so that the temperature of the leading end 14*b* of the ground electrode 14 was 800° C. under state in which the impact test was suspended. Under impact conditions of JISB8031 (2006), the spark plugs of embodiments 4, 13 and 14 were subject to the impact test ten times (N=10) for 120 minutes. In the evaluation, it was confirmed whether a crack was generated in the welded portion of the part protruded from the ground electrode.

In the embodiment 4, an axial average thickness W of the welding-protruded portion 14*e* that is protruded from the ground electrode 14 and includes 50 mass % or more of the constitutional components of the ground electrode was 0.05 mm≦W<0.1 mm. In the embodiment 13, the axial average thickness W of the welding-protruded portion 14*e* that is protruded from the ground electrode was 0.1 mm≦W<0.15 mm. In the embodiment 14, the axial average thickness W of the welding-protruded portion 14*e* that is protruded from the ground electrode was 0.15 mm≦W<0.25 mm. In the meantime, S2/S of the embodiments 4, 13 and 14 was 1.0. The evaluation result is shown in Table 3.

TABLE 3

| | W | whether or not crack |
|---|---|---|
| embodiment 4 | 0.05 mm ≦ W < 0.1 mm | generated |
| embodiment 13 | 0.1 mm ≦ W < 0.15 mm | not generated |
| embodiment 14 | 0.15 mm ≦ W < 0.25 mm | not generated |

As can be seen from Table 3, in the embodiment 4 in which the axial average thickness W of the welding-protruded portion 14*e* that is protruded from the ground electrode 14 and includes 50 mass % or more of the constitutional components of the ground electrode was under 0.1 mm, the welded portion was not separated in the impact test. However, a crack was generated in the welded portion and a portion having weak strength was seen. However, in the embodiments 13 and 14 in which the axial average thickness W was 0.1 mm or greater, a crack was not generated in the welded portion and the welding strength was further increased.

In the meantime, the invention is not limited to the above embodiments and may be appropriately modified or improved. For example, in the above embodiments, the noble metal chip 22 has been disposed at a position of the ground electrode 14, which is axially opposite to the noble metal chip 21 of the center electrode 13. However, the invention is not limited thereto. For example, the invention may be applied to a spark plug in which the noble metal chip 22 is disposed at a position that is radially spaced with regard to the noble metal chip 21 of the center electrode 123.

While the invention has been described with reference to exemplary embodiments thereof, the invention is not limited to these embodiments. It will be understood by those of ordinary skill in the art that various changes in form and details may be made therein within the invention.

This application claims the priority of Japanese Patent Application No. 2008-282751 filed on Nov. 4, 2008, the disclosures of which are incorporated herein by reference.

DESCRIPTIONS OF REFERENCE NUMERALS

11: metal shell
11*a*: leading end of metal shell
11*b*: welded portion of metal shell side
12: insulator
12*a*: leading end of insulator
13: center electrode
13*a*: leading end of center electrode
14: ground electrode
14*a*: base end of ground electrode
14*d*: welded portion of ground electrode side
14*e*: welding-protruded portion
22: noble metal chip
30: welding chuck
31: relief part
100: spark plug
g: spark discharge gap

The invention claimed is:

1. A spark plug comprising:

a cylindrical metal shell extending in an axial direction;

a cylindrical insulator that is held in the metal shell and includes a leading end exposed from a leading end of the metal shell;

a center electrode that is arranged in the insulator so that a leading end of the center electrode is exposed from the leading end of the insulator; and a ground electrode that includes a base end welded to a leading end surface of the metal shell so as to extend from the leading end of the metal shell, a spark discharge gap being formed between a leading end of the ground electrode and the leading end of the center electrode, wherein the base end of the ground electrode is welded to the leading end surface of the metal shell, the base end being protruded radially outward beyond an outer circumferential surface of the leading end of the metal shell and/or radially inward beyond an inner circumferential surface of the leading end of the metal shell, and wherein where S2 represents a sectional area of the welded part between the metal shell and the ground electrode, the sectional area S2 being cut off by a plane including the leading end surface of the metal shell, and S represents a sectional area of the ground electrode, the sectional area S being cut off by a plane which passes to a most leading end of a boundary in the axial direction between the ground electrode and the welded part and is perpendicular to the axial direction, a relation of S2≧S is satisfied.

2. The spark plug according to claim 1, wherein a relation of S2≧1. 1S is satisfied.

3. The spark plug according to claim 1, wherein the welded part includes a portion of the leading end of the metal shell, which is radially protruded when welding the metal shell and the ground electrode.

4. The spark plug according to claim 1, wherein a relation between a radial thickness t of the leading end of the metal shell and a thickness T of the base end of the ground electrode is t<T.

5. The spark plug according to claim 1, wherein an average thickness W of a welding-protruded portion of the welded part in the axial direction is 0.1 mm or greater (W≧0.1 mm), in which the welding-protruded portion is protruded outward beyond the ground electrode and includes 50 mass % or more of constitutional components of the ground electrode.

6. The spark plug according to claim 1, wherein the welding-protruded portion is formed at at least one of long sides of a cross sectional plane of the ground electrode.

7. The spark plug according to claim 1, wherein the metal shell includes a screw part formed at an outer circumference of the metal shell for attaching the spark plug to a counterpart member and a nominal diameter of the screw part is M 10 or less.

8. A method of manufacturing a spark plug comprising a cylindrical metal shell extending in an axial direction; a cylindrical insulator that is held in the metal shell and includes a leading end exposed from a leading end of the metal shell; a center electrode that is arranged in the insulator so that a leading end of the center electrode is exposed from the leading end of the insulator; and a ground electrode that includes a base end welded to a leading end surface of the metal shell so as to extend from the leading end of the metal shell, wherein a spark discharge gap is formed between a leading end of the ground electrode and the leading end of the center electrode, the method comprising:

preparing the metal shell including the leading end having a radial thickness t;

preparing the ground electrode including the base end having a thickness T smaller than the thickness t; and resistance welding the base end of the ground electrode to the leading end surface of the metal shell using a cylindrical welding chuck that includes a relief part formed at an edge of an inner circumferential surface of the welding chuck, in such a manner that the cylindrical welding chuck is fitted on the ground electrode and the edge of the inner circumferential surface of the welding chuck is located at the base end of the ground electrode;

wherein when a sectional area of the welded part between the metal shell and the ground electrode is indicated with S2, the sectional area S2 being cut off by a plane including the leading end surface of the metal shell, and a sectional area of the ground electrode is indicated with S, the sectional area S being cut off by a plane passing to the most leading end of a boundary in the axial direction between the ground electrode and the welded part and perpendicular to the axial direction, a relation of S2≧S is satisfied.

9. The method according to claim 8, wherein the metal shell includes a screw part formed at an outer circumference of the metal shell for attaching the spark plug to a counterpart member and a nominal diameter of the screw part is M 10 or less.

* * * * *